US006332660B1

(12) United States Patent
Salice

(10) Patent No.: US 6,332,660 B1
(45) Date of Patent: Dec. 25, 2001

(54) PIECE OF FURNITURE WITH A BODY PART CLOSEABLE BY A TWO-WING FOLDING SLIDING DOOR

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 0 days.

(21) Appl. No.: 09/306,004

(22) Filed: May 6, 1999

(30) Foreign Application Priority Data

May 6, 1998 (DE) ..... UM 298 08 185 U

(51) Int. Cl.[7] ..... A47B 88/00
(52) U.S. Cl. ..... 312/328; 160/207
(58) Field of Search ..... 16/93, 362, 364; 160/207; 312/328, 327, 323; 49/125, 126, 127, 197, 260

(56) References Cited

U.S. PATENT DOCUMENTS 788,761 5/1905 Erwood .
4,516,813 * 5/1985 Sekerich ..... 312/328
5,882,099 * 3/1999 Salice ..... 312/328

FOREIGN PATENT DOCUMENTS 630437 6/1982 (CH) .
1245556 7/1967 (DE) .
29602424 3/1996 (DE) .
29604354 6/1996 (DE) .
0210431 2/1987 (EP) .

* cited by examiner

*Primary Examiner*—Peter M. Cuomo
*Assistant Examiner*—Jerry A. Anderson
(74) *Attorney, Agent, or Firm*—Dilworth & Barrese LLP

(57) ABSTRACT

A piece of furniture with a body part closeable by a two-wing folding sliding door (2,6) is provided, the upper wing (2) of this body part being hinged around a horizontal swivel axis to the top panel (1) of the body part and the lower wing (6) being connected in an articulated manner to the upper wing (2) and guided in guide rails (7) of side panels (8) of the body part by support parts (15) mounted in the region of its outer corners, wherein the guide rails (7) are mounted to the narrow front sides of the side panels (8).

16 Claims, 3 Drawing Sheets

PIECE OF FURNITURE WITH A BODY PART CLOSEABLE BY A TWO-WING FOLDING SLIDING DOOR

BACKGROUND OF THE INVENTION

The invention relates to a piece of furniture having a body part closeable by a two-wing folding sliding door, the upper wing of which body part is hinged around a horizontal swivel axis to the top panel of the body part and the lower wing of which body part, which is connected in an articulated manner to the upper wing, is guided in guide rails of the side panels of the body part by means of support parts attached in the region of its outer corners and to a support part guided movably in a guide rail.

SUMMARY INVENTION

In a piece of furniture of this type known from DE-GM 296 04 354.0, the guide rails are fixed to the insides of the side panels so that they restrict the interior of the body part or wardrobe and no shelves or pull-out parts can be disposed which extend to the front sides of the side panels.

It is therefore the object of the invention to provide a piece of furniture of the type first mentioned where the interior can be utilized to the full and the disposition of shelves or pull-out parts up to the front side of the side panels is not hindered.

This object is solved in accordance with the invention by the guide rails being fixed to the narrow front sides of the side panels.

Thanks to the type of attachment of the guide rails in accordance with the invention, the whole interior of the body part between the side panels is available as storage space, with shelves or also pull-out parts extending to the front sides being able to be fixed to the side panels.

The guide rails appropriately consist of U-shaped rails whose legs are angled inwards at their ends and which are connected with their bottoms (web parts) to the front sides.

In the pieces of furniture known from DE-GM 296 04 354.0, the outer wings have to be connected to support parts of the type known from DE-GM 296 02 424.4 to allow the support parts to be introduced into the guide rails disposed on the insides of the side panels after the inner wing has been hinged to the top panel. To this extent, these known support parts make necessary a complex construction in that they are provided with slide parts swivellable by these through 90° which after their angling and introduction into the guide rails can be locked in these.

It is therefore another object of the invention to provide a more simple support part having a slide part guided movably in a guide rail which slide part is also in particular suitable for a door wing of a folding sliding door of a piece of furniture of the type first given.

This object is solved in accordance with the invention by the support part being able to be connected or locked to the slide part inserted in the guide rail by means of attachment means. The support part in accordance with the invention can be connected in a simple manner or locked in a simple manner to a slide part already inserted in the guide rail by means of special attachment means.

For example, with two-wing folding sliding doors, the problem exists that one inner wing has to be connected in an articulated manner with a top or side panel of a wardrobe or body part, while the outer corner regions of the outer door wing are connected to support parts which run in guide rails which are attached to the insides of the top or bottom panels or the side panels of the body part depending on whether the folding sliding door is swivellable through horizontal or vertical axes. To allow a simple assembly of such two-wing folding sliding doors, it is desirable to first fasten the inner wing to a top panel or a side panel by means of hinged joints and only then to mount the support part. Here, however, it must be taken into account that after the fastening of the inner door wing to a top or side panel, the folding sliding door is fixed in position so that it is problematic to introduce an already pre-assembled support part into the guide rails. The support part in accordance with the invention can be connected in a simple manner to the slide part inserted in the guide rail without a complex support part of the type known from DE-GM 296 02 424.04 having to be used.

A particularly simple connection of the support part to the slide part inserted in the guide rail is possible if the guide rails are attached to the narrow front sides of the side panels of the body part in the manner in accordance with the invention.

In accordance with a preferred embodiment, it is provided that the slide part adapted to the inner contour of the guide rail is provided with a snap-in recipient for the support part. The snap-in recipient can consist of a sleeve-shaped part and a dowel-shaped part which together form parts which can be coupled.

Appropriately, the snap-in recipient consists of a groove, with the support part being provided with an essentially complementary insert part.

To ensure a good and non-wobbling connection, the groove appropriately narrows in the shape of the part or the cone.

In another aspect of the invention, it is provided that the insert part is provided with a protrusion or an extension which is overlapped in the region of the end of the insert path in a locking manner by a roughly complementary elastically formable hook part.

The part provided with the elastically formable hook part appropriately consists of an elastically formable plastic, while the insert part can consist of plastic or metal, for example zamak.

The hook part is appropriately provided with an actuator, for example, an extension actuable by hand which allows the release of the interlock.

The flanks of the groove of the slide part appropriately possess grooves narrowing in a wedged-shaped manner in which the insert parts narrowing in a correspondingly wedge-shaped manner of the support part engage.

The hook part can be connected to the web part of the groove, with the protrusion being overlapped thereby being disposed on the end of the hook part positioned at the front in the direction of insertion.

In another aspect of the invention, it is provided that the support part is provided with at least one bearing borehole for a rotatable hinge part which is connected to the outer door wing of a folding sliding door so that this can perform the required swivel movement relative to the slide part guided in the guide rail during opening and closing. The rotatable bearing part can be connected to the fittings by two links.

Another problem with door wings of folding sliding doors of pieces of furniture of the type in accordance with the invention comprises, for example, the cup-shaped rotatable hinge parts having to be fixed to the outer corner regions of the outer door wing, this having to be done in such a way that they are disposed as closely as possible to the edges limiting the corners.

It is therefore another object to provide a cup-shaped rotatable hinge part being provided having a mounting flange for fixing to the edge of a blind borehole cut in a door wing which can be mounted securely and in a fixed manner despite the tight room relationships.

This object is solved in accordance with the invention by a widened flange part having mounting boreholes being provided parallel to the swivel axis of the hinge part. This flange part is appropriately located on that side of the cup-shaped hinge part opposite the hinge axes and is connected to a shelf running all around where possible.

In accordance with a preferred embodiment, it is provided that the mounting boreholes are provided on the lower side of the widened flange part with edges formed in the shape of truncated cones which engage around complementary pre-bored holes of the door wing. In this way, a good assembly and centration of the cup-shaped hinge part is achieved while taking into account the tight space relationships in the corner regions of the outer door wing.

In accordance with another preferred embodiment, for which independent protection is claimed, it is provided that the cup-shaped hinge part is provided on its side facing or facing away from the swivel axis with a truncation running obliquely to the floor and, on the opposite side, with saw-tooth-shaped extensions. In this way, the cup-shaped hinge part can first be inserted with the saw-tooth-shaped extensions obliquely into the pre-bored hole, with a secure anchoring of the hinge part in the pre-bored hole being created when the opposite side is pressed fully into the borehole with the obliquely running truncation. By means of this pressing in, the saw-tooth-shaped extensions cut into the wall of the borehole so that a good anchoring is achieved.

The side provided with the saw-tooth-shaped extensions is appropriately opposite a widened mounting flange.

BACKGROUND OF THE INVENTION

One embodiment of the invention is explained in detail below by means of the accompanying drawings, in which FIG. 1 shows a section through a wardrobe closed by a two wing folding sliding door with a side view of a retaining fitting and of the retaining part guided in a guide rail mounted on a side panel of the body part, which retaining part is connected in an articulated manner to the lower end region of the lower wing of the folding sliding door;

DESCRIPTION OF THE PREFERRED EMBODIMENTS

Figure 1:
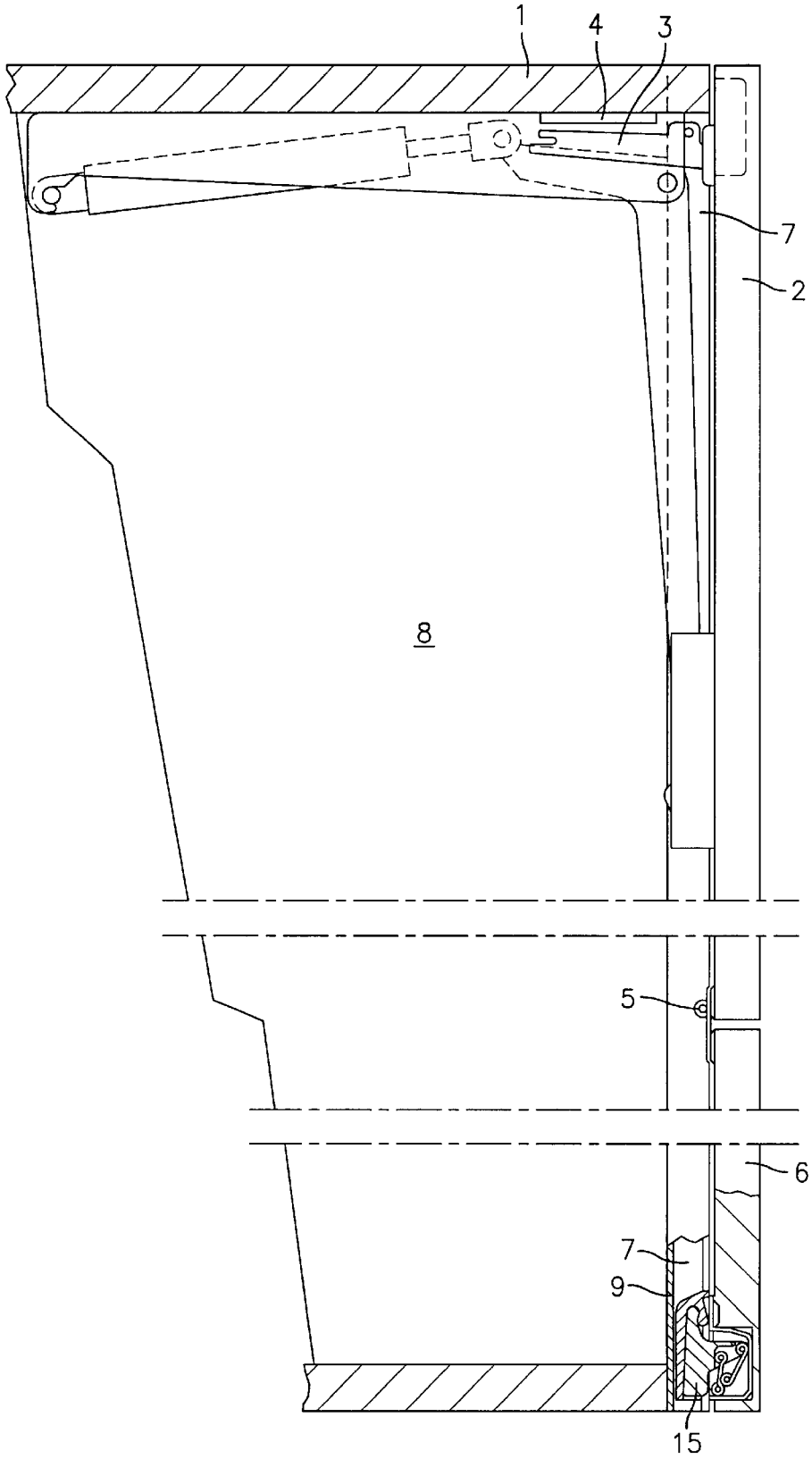

In FIG. 1, a cross-section through the body part, for example of a wardrobe, can be seen on whose top panel 1 the upper wing 2 of a folding sliding door is hinged by means of conventional four-bar hinges. The hinge arms 3 of the four-bar hinges are mounted in the manner shown to the inside of the top panel 1 in its outer edge region by conventional mounting plates 4.

A lower wing 6 is connected in an articulated manner to the upper wing 2 in the usual manner by a hinge band 5.

The folding sliding door 2, 5, 6 is provided with a retaining fitting and a lift apparatus such as are known, for example, from DE-GM 296 04 354.0 to which reference is made for a more detailed representation.

Figure 2:
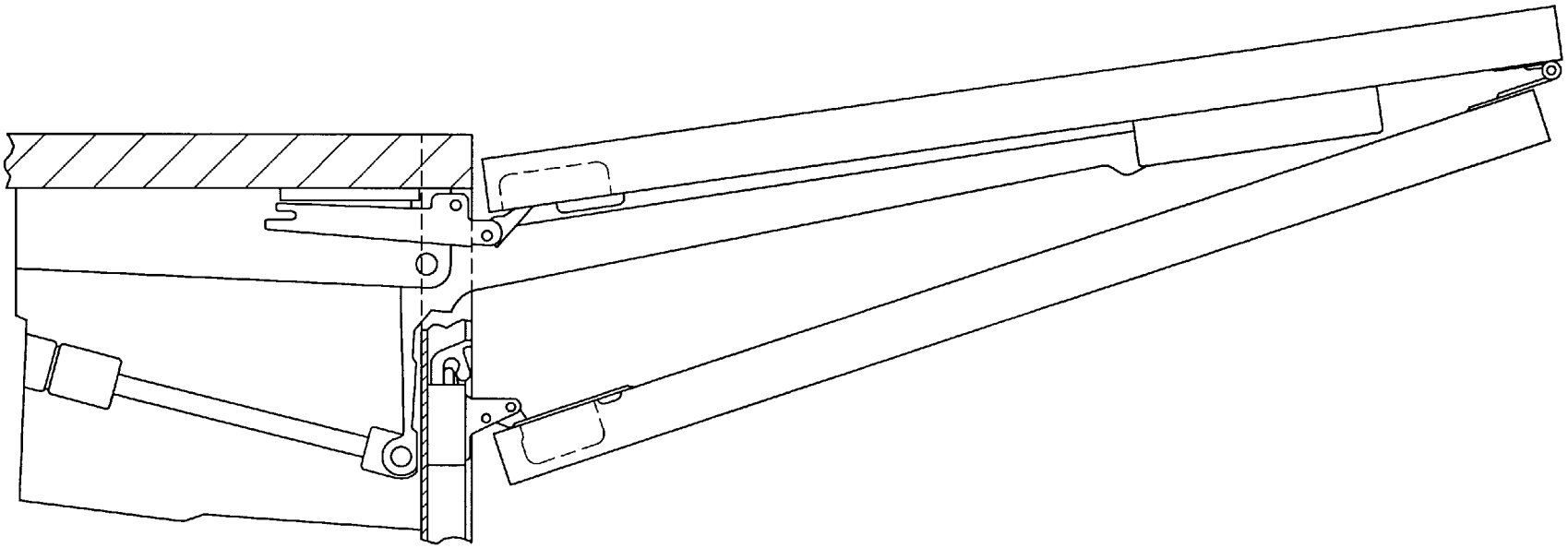
FIG. 2 shows a section or a side view from FIG. 1 in which the two wing folding sliding door is in its open position.

Unlike the piece of furniture known from DE-GM 296 04 354.0, in the body part visible in FIGS. 1 and 2, the side guide rails 7 for the support parts of the lower edge of the lower door wing 6 are mounted to the narrow front sides 8 of the body part in such a way that these do not protrude inwards over the narrow front sides. The bottoms or web parts 9 of the guide rails 7 are provided at intervals with mounting boreholes for mounting screws with which these are mounted to the narrow front sides of the side panels 8.

Figure 3:
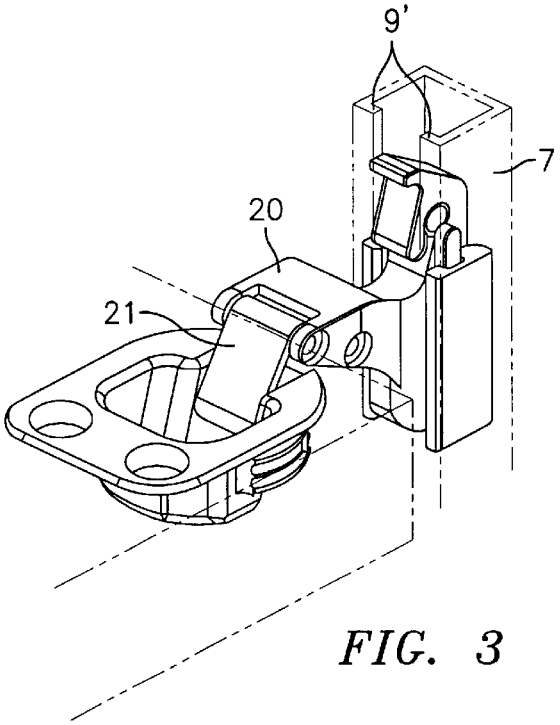
FIG. 3 shows a perspective view of a support part having a hinge part rotatably connected thereto which is interlocked with a slide part movable in a guide rail.
Figure 4:
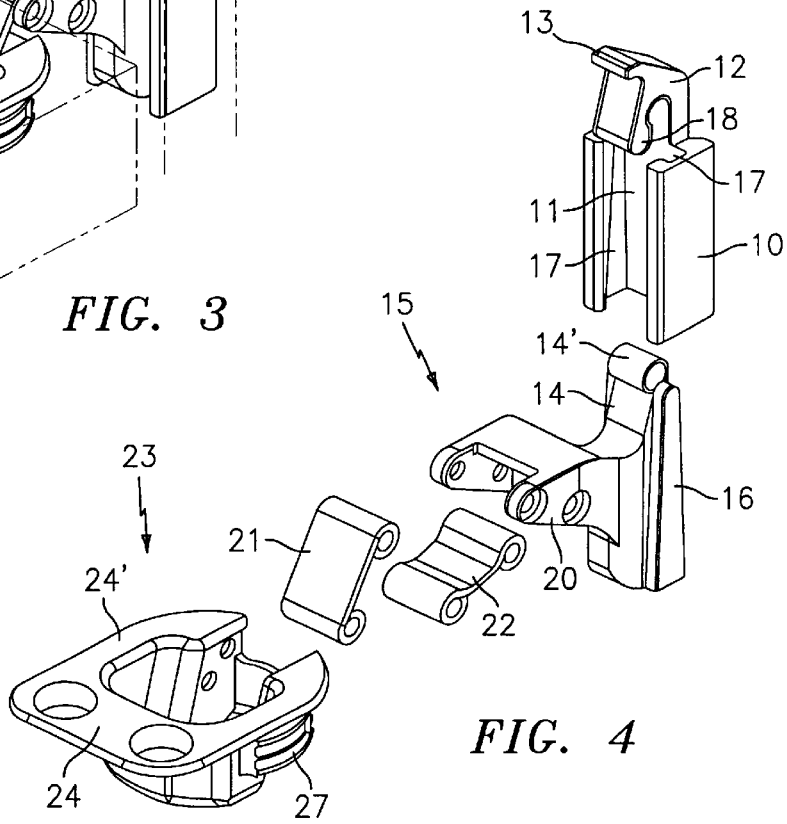
FIG. 4 shows a perspective view of the slide part, the support part and the hinge part rotatably connected thereto of FIG. 3 in an exploded view of the individual parts.
Figure 5:
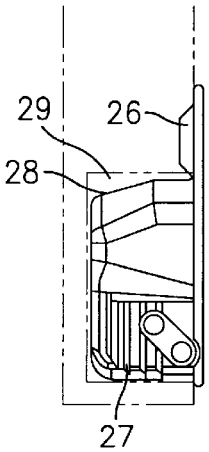
FIG. 5 shows a side view of the button-shaped hinge part inserted in a blind borehole.
Figure 6:
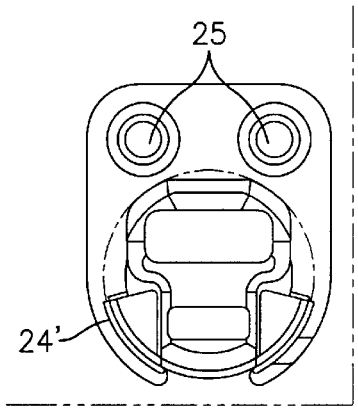
FIG. 6 shows a bottom view of the cup-shaped hinge part of FIG. 5.

The guide rails 7 possess in the manner visible in FIG. 3 a U-shaped section, with the section legs parallel to one another possessing at their free ends borders 9' aligned towards one another inwardly. In each guide rail formed by the section 7, a longitudinal slider-like slide part 10 is guided whose cross-section essentially corresponds to the inner contour of the guide rail 7. The slide part therefore possesses essentially a rectangular circumferential shape and is provided with a central groove 11. The web part of the slide part 10 is extended on one side and forms a hook-like part 12 with a prolongation 13 serving actuation, for example by means of the thumb. An insert part 14 of a support part 15 can be inserted into the groove 11 of the slide part 10 from the side opposite the hook 12. The insert part 14 possesses an essentially cuboid shaped shape and is provided on both of its sides with extensions 16 narrowing in a wedge-shaped manner which engage correspondingly complementary recesses 17 in the flanks of the groove 11 of the slide part 10 so that the insert part 14, after insertion into the groove 11, is mounted therein without any play. At its front end, the insert part 14 possesses a protrusion-like thickening 14' which in the inserted state of the insert part 14 in the groove 11 is overlapped by the hook-like extension 18 of the hook part 12. If the insert part 14 is pushed into the groove 11 of the slide part, the hook-like extension 18 snaps in the inserted position over the protrusion-like thickening 14' so that the insert part is interlocked in the inserted position. The slide part appropriately consists of an injection molded part made of elastic plastic so that the interlocking can be simply released again by the hook-like extension 18 of the hook part 12 being rotated by pressure on the actuator part 13 into its released position.

A bearing block 20, whose forked legs are provided with flush bearing boreholes, is connected to the insert part 14. In the bearing boreholes, the links 21, 22 are supported by bearing bolts (not shown), which links are supported at their other ends in the usual way by bearing bolts (not shown) in bearing boreholes of the cup-shaped hinge part 23. The insert part 14 and the cup-shaped hinge part 23 can consist in a usual manner of metal, for example zamak. The links 21, 22 appropriately consist of sections of strip steel with rolled-in bearing lugs.

The hinge head 23 is provided on its side opposite the articulation position of the links 21 with a widened mounting flange 24 which is provided with two mounting boreholes. The edges 26 of the boreholes 25 are formed on the lower side of the widened mounting flange 24 in the shape of truncated cones. They engage correspondingly recessed edges of the mounting boreholes in the lower door wing to center the bearing part 23.

The hinge part 23 is provided on its outside on the side opposite the mounting flange 24 with ribs 27 running parallel to one another with a saw-tooth-shaped profile. The ribs 27 extend in the manner shown only over the front circumferential region of the hinge part which is smaller than 180°.

On the opposite outside, the hinge part is provided with a truncation 28. In this way, the hinge part can be inserted obliquely into the cut blind borehole 29 which is located in the manner visible in FIG. 3 in the outer angle region of the lower door wing 6. In the oblique insertion, the saw-tooth-shaped extensions 27 are supported on a region of the blind borehole 29. The oblique design 28 then allows a full swivelling in of the hinge part 23 inserted obliquely in the blind borehole 29 in a manner such that the saw-tooth-shaped extensions cut into the side panel and thus fix the hinge part 23 well into position. The edges 26 shaped like a truncated cone of the widened flange 24 engage the pre-bored recesses so that the hinge part is held securely while being centerd well after screwing in the mounting screws in the blind borehole 29.

The special type of the design of the hinge part allows this to be mounted in the outer corner regions of the inside of the outer door wing 6 in a space-saving manner.

What is claimed is:

1. A piece of furniture with a body part closeable by a two-wing folding sliding door (2,6), an upper wing (2) of the door being hinged around a horizontal swivel axis to a top panel (1) of the body part and a lower wing (6) of the door being connected in an articulated manner to the upper wing (2) and being guided in guide rails (7) of side panels (8) of the body part by at least one support part (15) mounted in a region of outer corners of the lower wing (2), wherein the guide rails (7) are mounted to narrow front sides of the side panels (8), and each possess a U-shaped section, having legs (9) angled inwardly at ends thereof and being connected to the front sides of the side panels (8) at bottoms thereof, and said at least one support part (15) comprises a slide part (10) contained and guided movably in one of said guide rails (7), and an insert part (14) separably couplable with said slide part (10), said slide part (10) structured and arranged to remain in said respective guide rail (7) when said insert part (14) is uncoupled therefrom, and said slide part (10) comprises a snap-in recipient for said insert part (14) such that said insert part (14) can be easily locked into said slide part (10).

2. The furniture piece of claim 1, wherein said snap-in recipient comprises a groove (11) with said insert part (14) being essentially complementary thereto.

3. The furniture piece of claim 2, wherein said groove (11) narrows in a wedge or conical shape.

4. The furniture piece of claim 3, wherein said insert part (14) is provided with a protrusion (14') or an extension which is overlapped in a region of an end of said insert part (14) in an interlocking manner by an approximately complementary, elastically deformable hook part (12) of said slide part (10).

5. The furniture piece of claim 1, wherein said slide part (10) is additionally provided with an actuating apparatus (13) to release interlocking of said slide part (10) with said insert part (14).

6. The furniture piece of claim 5, additionally comprising a prolongation (13) situated upon said elastically deformable hook part (12) and constituting an actuating apparatus (13) for releasing coupling of said insert part (14) with said slide part (10) by being rotated.

7. The furniture piece of claim 1, wherein said snap-in recipient of said slide part (10) comprises a hook-like extension (18) from an elastically deformable hook part (12) mounted upon said slide part (10), and said insert part (14) comprises a protrusion (14') which is arranged to be overlapped in a region of an end of said insert part (14) in an interlocking manner by said hook-like extension (18) on said slide part (10).

8. The furniture piece of claim 7, wherein said snap-in recipient of said slide part (10) comprises a hook-like extension (18) from said elastically deformable hook part (12) mounted upon said slide part (10), and said insert part (14) comprises said protrusion (14') which is arranged to be overlapped in a region of the end of insert part (14) in an interlocking manner by said hook-like extension (18) on said slide part (10).

9. The furniture piece of claim 2, wherein said groove (11) of said slide part (10) possesses flanks (17) narrowing in a wedge-shaped manner, in which said insert part (14) narrowing in a correspondingly wedge-shaped manner, engages.

10. The furniture piece of claim 4, wherein said elastically deformable hook part (12) is connected to a bottom of said groove (11) of said slide part (10) and said protrusion (14') of said insert part (14) overlapped thereby is situated at the end of said insert part (14) disposed at a front of an insert direction into said slide part (10).

11. The furniture piece of claim 1, wherein said insert part (14) is provided with at least one bearing borehole for a swivellable hinge part (23) which is connected to the lower or outer door wing (6) of the folding sliding door.

12. The furniture piece of claim 11, wherein the swivellable hinge part (23) is connected to the support part (15) by two links (21, 22).

13. The furniture piece of claim 12, wherein said insert part (14) comprises a bearing block 20 in turn provided with forked legs containing said respective boreholes for receiving said hinge part (23) by said links (21, 22) being mounted in said bearing boreholes of said insert part (14) and in bearing boreholes of said cup-shaped hinge part (23).

14. The furniture piece of claim 1, additionally comprising a cup-shaped swivellable hinge part (23) having a mounting flange structured and arranged for mounting at an edge of a blind borehole (29) cut in said lower or outer door wing (6), with said hinge part (23) possessing a widened flange part (24) parallel to a swivel axis and having mounting boreholes (25) and which is connected to a shelf (24') running substantially all the way around.

15. The furniture piece of claim 14, wherein said mounting boreholes (25) are provided on a lower side of said widened flange part (24) with edges (26) shaped in the form of truncated cones for engaging complementary pre-bored holes of said door wing (6).

16. The furniture piece of claim 14, wherein said hinge part (23) is provided, on a side thereof facing or facing away from the swivel axis, with a truncation (28) running obliquely to a bottom thereof and on an opposite side with saw-toothed-shaped extensions (27).

* * * * *